US010499164B2

(12) United States Patent
Li et al.

(10) Patent No.: US 10,499,164 B2
(45) Date of Patent: Dec. 3, 2019

(54) PRESENTATION OF AUDIO BASED ON SOURCE

(71) Applicant: Lenovo (Singapore) Pte. Ltd., New Tech Park (SG)

(72) Inventors: Scott Wentao Li, Cary, NC (US); Russell Speight VanBlon, Raleigh, NC (US); Liang Chen, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 248 days.

(21) Appl. No.: 14/661,143

(22) Filed: Mar. 18, 2015

(65) Prior Publication Data

US 2016/0277850 A1 Sep. 22, 2016

(51) Int. Cl.
*H04R 25/00* (2006.01)

(52) U.S. Cl.
CPC ..... *H04R 25/40* (2013.01); *H04R 2201/40* (2013.01); *H04R 2225/61* (2013.01); *H04R 2227/003* (2013.01); *H04R 2460/07* (2013.01)

(58) Field of Classification Search
CPC ..... H04R 2225/39; H04R 2225/41; H04R 2460/07; H04R 25/40; H04R 25/405; H04R 2430/20; G10L 15/25; G10L 2021/02166; G10L 21/028; G10L 25/78; G10L 2025/783; G10L 15/24
See application file for complete search history.

(56) References Cited

U.S. PATENT DOCUMENTS 2,510,344 A 6/1950 Law
2,567,654 A 9/1951 Siezen
3,418,426 A 12/1968 Schlegel et al.
3,628,854 A 12/1971 Jampolsky
4,082,433 A 4/1978 Appeldorn et al.
4,190,330 A 2/1980 Berreman
4,577,928 A 3/1986 Brown
(Continued)

FOREIGN PATENT DOCUMENTS

DE 10310794 9/2004
DE 69937592 10/2008
(Continued)

OTHER PUBLICATIONS

Hart, J., Onceanu, D., Sohn, C., Wightman, D., and Vertegaal, R. (2009). "The attentive hearing aid: Eye selection of auditory sources for hearing impaired users," in Interact 2009, Part I, LNCS 5726, edited by T. Gross, J. Gulliksen, P. Kotze, L. Oestreicher, P. Palanque, R. Oliveira Prates, and M. Winckler (Springer, Berlin), pp. 19-35.*
(Continued)

*Primary Examiner* — Kile O Blair
(74) *Attorney, Agent, or Firm* — John L. Rogitz; John M. Rogitz

(57) ABSTRACT

In one aspect, a device includes a processor, at least one camera accessible to the processor, and memory accessible to the processor. The memory bears instructions executable by the processor to identify, at least in part based on input from the at least one camera, a source of sound. The instructions are also executable to, based at toast in part on input from at least one microphone, execute beamforming and provide audio at a hearing aid comprising sound from the source.

20 Claims, 7 Drawing Sheets

(56) References Cited

U.S. PATENT DOCUMENTS

| | | | | |
|---|---|---|---|---|
| 5,579,037 | A | 11/1996 | Tahara et al. | |
| 5,583,702 | A | 12/1996 | Cintra | |
| 6,046,847 | A | 4/2000 | Takahashi | |
| 6,975,991 | B2 * | 12/2005 | Basson | A61F 11/04 704/271 |
| 8,781,142 | B2 * | 7/2014 | Olafsson | H04R 25/407 381/312 |
| 8,867,763 | B2 * | 10/2014 | Bouse | H04R 25/40 381/313 |
| 9,084,038 | B2 * | 7/2015 | Siotis | H04R 3/005 |
| 9,167,356 | B2 * | 10/2015 | Higgins | H04R 25/40 |
| 9,264,824 | B2 * | 2/2016 | Pruthi | G06F 3/04842 |
| 9,460,732 | B2 * | 10/2016 | Wingate | G10L 21/0272 |
| 9,769,588 | B2 * | 9/2017 | Shenoy | H04S 7/302 |
| 2004/0160419 | A1 | 8/2004 | Padgitt | |
| 2009/0065578 | A1 | 3/2009 | Peterson et al. | |
| 2009/0204410 | A1 | 8/2009 | Mozer et al. | |
| 2009/0259349 | A1 | 10/2009 | Golenski | |
| 2009/0315740 | A1 | 12/2009 | Hildreth et al. | |
| 2010/0074460 | A1 * | 3/2010 | Marzetta | G02C 11/06 381/313 |
| 2010/0079508 | A1 | 4/2010 | Hodge et al. | |
| 2010/0171720 | A1 | 7/2010 | Craig et al. | |
| 2010/0211918 | A1 | 8/2010 | Liang et al. | |
| 2011/0065451 | A1 | 3/2011 | Danado et al. | |
| 2012/0149309 | A1 | 6/2012 | Hubner et al. | |
| 2012/0220311 | A1 | 8/2012 | Rodriguez et al. | |
| 2012/0268268 | A1 | 10/2012 | Bargero | |
| 2013/0021459 | A1 | 1/2013 | Vasilieff et al. | |
| 2013/0044042 | A1 | 2/2013 | Olsson et al. | |
| 2013/0170755 | A1 | 7/2013 | Dalton et al. | |
| 2013/0246663 | A1 | 9/2013 | Raveendran et al. | |
| 2013/0307771 | A1 | 11/2013 | Parker et al. | |
| 2014/0233774 | A1 * | 8/2014 | Kim | H04R 25/30 381/315 |
| 2014/0317524 | A1 | 10/2014 | VanBlon et al. | |
| 2015/0022636 | A1 * | 1/2015 | Savransky | H04R 3/00 348/46 |
| 2015/0172830 | A1 * | 6/2015 | Liu | H04R 25/40 381/313 |
| 2015/0362988 | A1 * | 12/2015 | Yamamoto | G06F 3/011 345/156 |

FOREIGN PATENT DOCUMENTS

| | | |
|---|---|---|
| EP | 0880090 | 11/1998 |
| WO | 2004051392 | 6/2004 |

OTHER PUBLICATIONS

Russell Speight Vanblon, Neal Robert Caliendo Jr.; "Automatic Magnification and Selection Confirmation" file history of related U.S. Appl. No. 14/322,119 filed Jul. 2, 2014.

Russell Speight Vanblon, Neal Robert Caliendo Jr.; "Magnification Based on Eye Input" file history of related U.S. Appl. No. 14/546,962 filed Nov. 18, 2014.

Russell Speight Vanblon, Suzanne Marion Beaumont, Rod David Waltermann, "Detecting Pause in Audible Input to Device" file history of related U.S. Appl. No. 14/095,369 filed Dec. 3, 2013.

Suzanne Marion Beaumont, Russell Speight Vanblon, Rod D. Waltermann, "Devices and Methods to Receive Input at a First Device and Present Output in Response on a Second Device Different from the First Device" file history of related U.S. Appl. No. 14/095,093 filed Dec. 3, 2013.

Jonathan Gaither Knox, Rod D. Waltermann, Liang Chen, Mark Evan Cohen, "Initiating Personal Assistant Application Based on Eye Tracking and Gestures" file history of related U.S. Appl. No. 14/095,235 filed Dec. 3, 2013.

Nathan J. Peterson, John Carl Mese, Russell Speight Vanblon, Arnold S. Weksler, Rod D. Waltermann, Xin Feng, Howard J. Locker, "Systems and Methods to Present Information on Device Based on Eye Tracking" file history of related U.S. Appl. No. 14/132,663 filed Dec. 18, 2013.

Russell Speight Vanblon, Rod David Waltermann, John Carl Mese, Arnold S. Weksler, Nathan J. Peterson, "Detecting Noise or Object Interruption in Audio Video Viewing and Altering Presentation Based Thereon" file history of related U.S. Appl. No. 14/158,990 filed Jan. 20, 2014.

Russell Speight Vanblon, Axel Ramirez Flores, Jennifer Greenwood Zawacki, Alan Ladd Painter, "Skin Mounted Input Device" file history of related U.S. Appl. No. 14/162,115 filed Jan. 23, 2014.

Axel Ramirez Flores, Rod David Waltermann, James Anthony Hunt, Bruce Douglas Gress, James Alan Lacroix, "Glasses with Fluid-Fillable Membrane for Adjusting Focal Length of One or More Lenses of the Glasses" file history of related U.S. Appl. No. 14/453,024 filed Aug. 6, 2014.

Steven Richard Perrin, Jianbang Zhang, John Weldon, Scott Edwards Kelso, "Initiating Application and Performing Function Based on Input" file history of related application U.S. Appl. No. 14/557,628 filed Dec. 2, 2014.

Rod David Waltermann, John Carl Mese, Nathan J. Peterson, Arnold S. Weksler, Russell Speight Vanblon, "Movement of Displayed Element from One Display to Another" file history of related U.S. Appl. No. 14/550,107 filed Nov. 21, 2014.

Amy Leigh Rose, Nathan J. Peterson, John Scott Crowe, Bryan Loyd Young, Jennifer Lee-Baron, "Presentation of Data on an at Least Partially Transparent Display Based on User Focus" file history of related U.S. Appl. No. 14/548,938 filed Nov. 20, 2014.

Rod David Waltermann, Russell Speight Vanblon, Nathan J. Peterson, Arnold S. Weksler, John Carl Mese, "Authentication Based on Body Movement" file history of related U.S. Appl. No. 14/643,132 filed Mar. 10, 2015.

Grigori Zaitsev, Russell Speight Vanblon, "Projection of Images on Side Window of Vehicle" filed history of related U.S. Appl. No. 14/639,263 filed Mar. 5, 2015.

Amy Leigh Rose, Nathan J. Peterson, John Scott Crowe, Bryan Loyd Young, "Prevention of Light from Exterior to a Device Having a Camera from Being Used to Generate an Image Using the Camera Based on the Distance of a User to the Device" file history of related U.S. Appl. No. 14/659,803 filed Mar. 17, 2015.

Russell Speight Vanblon, Jianbang Zhang, John Weldon Nicholson, "Execution of Function Based on Location of Display at Which a User is Looking and Manipulation of an Input Device" file history of related U.S. Appl. No. 14/643,505 filed Mar. 10, 2015.

David W. Douglas, Joseph David Plunkett, "Camera That Uses Light from Plural Light Sources Disposed on a Device" file history of related U.S. Appl. No. 14/670,753 filed Mar. 27, 2015.

Insight News, "Electronic-lens company PixelOptics is bankrupt", htttp://www.insightnews.com.au/_blog/NEWS_NOW!/post/lens/electronic-lens-company-pixeloptics-is-bankrupt/. Dec. 12, 2013.

Wikipedia, "Extended Display Identification Data", Definition; http://en.wikipedia.org/wiki/Extended_display_Identification_data, printed from website Oct. 10, 2014.

Extron , "Digital Connection, Understanding EDID—Extended Display Identification Data", Fall 2009, www.extron.com.

"Relationship Between Inches, Picas, Points, Pitch, and Twips", Article ID: 76388; http://support2.microsoft.com/KB/76388. Printed Oct. 10, 2014.

Wikipedia, "Polarizer" Definition; http://en.wikipedia.org/wiki/Polarizer, printed from website Jan. 14, 2015.

Wikepedia, "Smart Glass" Definition, http://en.wikipedia.org/wiki/Smart_glass, printed from website Jan. 14, 2015.

Wikipedia, "Microphone array", definition, http://en.wikipedia.org/wiki/Microphone_array, printed from website Jan. 22, 2015.

Wikipedia, "Beamforning", definition; http://en.wikipedia.org/wiki/Beamforming, printed from website Jan. 22, 2015.

"Understanding & Using Directional Microphones", http://www.soundonsound.com/sos/sep00/articles/direction.htm; Published in SOS Sep. 2000.

Wikipedia, "Microphone", definition; http://en.wilipedia.org/wkik/microphone, printed from website Jan. 22, 2015.

Thalmiclabs, "Myo-Tech Specs", http://www.thalmic.com/en/myo/techspecs, printed from website Jan. 27, 2015.

(56) References Cited

OTHER PUBLICATIONS

Thalmiclabs, "Myo Gesture Control Armband" http://www.thalmic.com/en/myo, printed from website Jan. 27, 2015.
Wikipedia, "Electromyography", definition; http://en.wikipedia.org/wiki/Electromyogrpahy, printed from website Jan. 27, 2015.
Isource: "Raise to Speak Makes Siri Wonderfully Useful (Once You Know How to Use It)", http:///isource.com/10/01/raise-to-speak-makes-siri-wonderfully-useful-once-you-know-how-to-use-it./ Web printout Nov. 15, 2013.
Tactus Technology, "Taking Touch Screen Interfaces Into a New Dimension", 2012 (13 pages).
Arthur Davis, Frank Kuhnlenz, "Optical Design Using Fresnel Lenses, Basic Principles and some Practical Examples" Optik & Photonik, Dec. 2007.
Superfocus, "See the World in Superfocus Revolutionary Eyeglasses Give You the Power to Focus Your Entire View at Any Distance", http://superfocus.com/eye-care-practitioners, printed from website Jun. 24, 2014.
Darren Quick, "PixelOptics to Launch 'world's first electronic focusing eyewear'", http://www.gizmag.com/pixeloptics-empower-electroni-focusing-glasses/17569/. Jan. 12, 2011.
Vibewrite Lernstift 'Jules Verne Edition', website printout Jan. 20, 2015, http://vibewrite.com/shop/index.php?route=product/product&path=59&product_id=52.
Livescribe:: Never Miss a Word. Website printout Jan. 20, 2015, http://www.livescribe.com/en-us/.
Livescribe:: Never Miss a Word, What is a Pencast? Website printout Jan. 20, 2015, http://www.livescribe.com/en-us-pencasts/.

* cited by examiner 502 504 506 500

| Object | User Identified? | Capable? |
|---|---|---|
| TV | No | Yes |
| Vase | No | No |
| Person 1 | No | Yes |
| Person 2 | Yes | Yes |
| Speakers | Yes | N/A |
| Radio | No | Yes |
| Couch | No | No |

PRESENTATION OF AUDIO BASED ON SOURCE

FIELD

The present application relates generally to the presentation of audio based on its source.

BACKGROUND

Many hearing aids receive and present sound collected from any and all directions. Even hearing aids that have directional capability unfortunately are limited by a fixed direction from which they are able to receive sound (e.g. in front of the user when the user is wearing the hearing aid). Thus, when a user turns their had away while conversing with another person to do something like e.g. take a bite of food, audio from the other person with which they are conversing will not be presented using the hearing aid until the user returns their head to the position in which the fixed direction of the hearing aid is directed toward the other person.

SUMMARY

Accordingly, in one aspect a device includes a processor, at least one camera accessible to the processor, and memory accessible to the processor. The memory bears instructions executable by the processor to identify, at least in part based on input from the at least one camera, a source of sound. The instructions are also executable to, based at least in part on input from at least one microphone, execute beamforming and provide audio at a hearing aid comprising sound from the source.

In another aspect, a method includes identifying, at least in part based on at least one image from at least one camera at least one source of sound. The method also includes, based on the identifying of the source of sound and based at least in part on at least one signal from at least one microphone, performing signal processing on the at least one signal and presenting audio at a device comprising sound from the source.

In still another aspect, a device includes a processor, at least one sensor accessible to the processor, and memory accessible to the processor. The memory bears instructions executable by the processor to identify, at least in part based on input from the sensor, an object capable of emitting sound. The memory also bears instructions executable by the processor to, based at least in part on the identification, target the object for presentation on at least one speaker of sound emanating from the object.

The details of present principles, both as to their structure and operation, can best be understood in reference to the accompanying drawings, in which like reference numerals refer to like parts, and in which:

DETAILED DESCRIPTION

Figure 1:
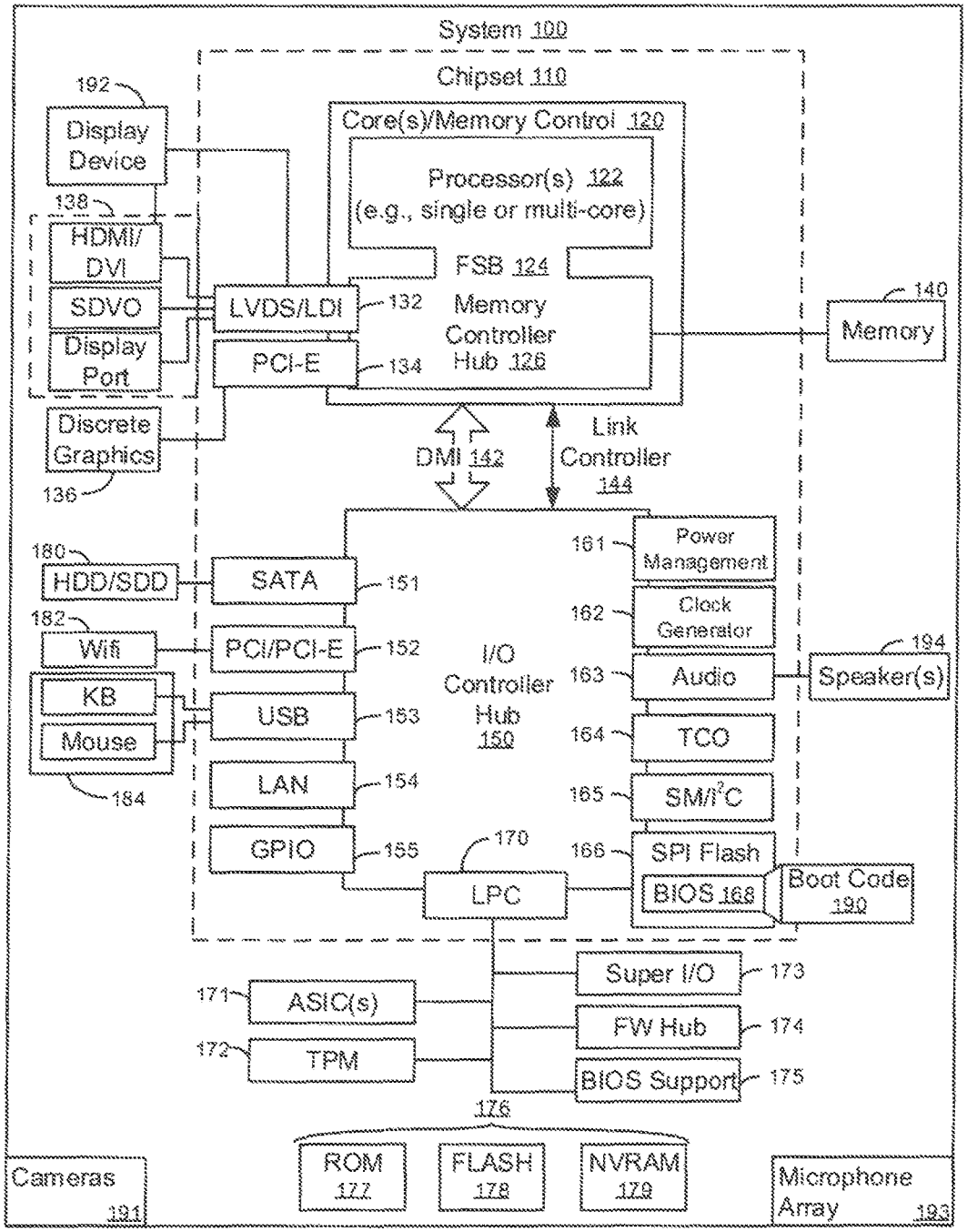
FIG. 1 is a block diagram of an example system in accordance with present principles.

This disclosure relates generally to device-based information. With respect to any computer systems discussed herein, a system may include server and client components, connected over a network such that data may be exchanged between the client and server components. The client components may include one or more computing devices including televisions (e.g. smart TVs, Internet-enabled TVs), computers such as desktops, laptops and tablet computers, so-called convertible devices (e.g. having a tablet configuration and laptop configuration), and other mobile devices including smart phones. These client devices may employ, as non-limiting examples, operating systems from Apple, Google, or Microsoft. A Unix or similar such as Linux operating system may be used. These operating systems can execute one or more browsers such as a browser made by Microsoft or Google or Mozilla or other browser program that can access web applications hosted by the Internet servers over a network such as the Internet, a local intranet, or a virtual private network.

As used herein, instructions refer to computer-implemented steps for processing information in the system. Instructions can be implemented in software, firmware or hardware; hence, illustrative components, blocks, modules, circuits, and steps are set forth in terms of their functionality.

A processor may be any conventional general purpose single-or multi-chip processor that can execute logic by means of various lines such as address lines, data lines, and control lines and registers and shift registers. Moreover, any logical blocks, modules, and circuits described herein can be implemented or performed, in addition to a general purpose processor, in or by a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

An software and/or applications described by way of flow charts and/or user interfaces herein can include various sub-routines, procedures, etc. It is to be understood that logic divulged as being executed by e.g. a module can be redistributed to other software modules and/or combined together in a single module and/or made available in a shareable library.

Logic when implemented in software, can be written in an appropriate language such as but not limited to C# or C++, and can be stored on or transmitted through computer-readable storage medium (e.g. that may not be a transitory signal) such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and twisted pair wires. Such connections may include wireless communication connections including infrared and radio.

In an example, a processor can access information over its input lines from data storage, such as the computer readable storage medium, and/or the processor can access information wirelessly from an Internet server by activating a wireless transceiver to send and receive data. Data typically is converted from analog signals to digital by circuitry between the antenna and the registers of the processor when being received and from digital to analog when being transmitted. The processor then processes the data through its shift registers to output calculated data on output lines, for presentation of the calculated data on the device.

Components included in one embodiment can he used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone. C alone, A and B together, A and C together, B and C together, and/or A, B, and C together, etc.

"A system having one or more of A, B, and C" (likewise "a system having one or more of A, B, or C" and "a system having one or more A, B, C") includes systems that have A alone, B alone, C alone, A and B together, A and C together, B and C together, and/or A, B, and C together, etc.

The term "circuit" or "circuitry" is used in the summary, description, and/or claims. As is well known in the art, the term "circuitry" includes all levels of available integration, e.g., from discrete logic circuits to the highest level of circuit integration such as VLSI, and includes programmable logic components programmed to perform the functions of an embodiment as well as general-purpose or special-purpose processors programmed with instructions to perform those functions.

Now specifically in reference to FIG. 1, it shows an example block diagram of an information handling system and/or computer system 100. Note that in some embodiments the system 100 may be a desktop computer system, such as one of the ThinkCentre® or ThinkPad® series of personal computers sold by Lenovo (US) Inc. of Morrisville, N.C. or a workstation computer, such as the ThinkStation®, which are sold by Lenovo (US) Inc. of Morrisville, N.C.; however, as apparent from the description herein, a client device, a server or other machine in accordance with present principles may include other features or only some of the features of the system 100. Also, the system 100 may be e.g. a game console such as XBOX® or Playstation®.

As shown in FIG. 1, the system 100 includes a so-called chipset 110. A chipset refers to a group of integrated circuits, or chips, that are designed to work together. Chipsets are usually marketed as a single product (e.g., consider chipsets marketed under the brands INTEL®, AMD®, etc.).

In the example of FIG. 1, the chipset 110 has a particular architecture, which may vary to some extent depending on brand or manufacturer. The architecture of the chipset 110 includes a core and memory control group 120 and an I/O controller hub 150 that exchange information (e.g., data, signals, commands, etc.) via, for example, a direct management interface or direct media interface (DMI) 142 or a link controller 144. In the example of FIG. 1, the DM1 142 is a chip-to-chip interface (sometimes referred to as being a link between a "northbridge" and a "southbridge").

The core and memory control group 120 include one or more processors 122 (e.g., single core or multi-core, etc.) and a memory controller hub 126 that exchange information via a front side bus (FSB) 124. As described herein, various components of the core and memory control group 120 may be integrated onto a single processor die, for example, to make a chip that supplants the conventional "northbridge" style architecture.

The memory controller hub 126 interfaces with memory 140. For example, the memory controller hub 126 may provide support for DDR SDRAM memory (e.g., DDR, DDR2, DDR3, etc.). In general, the memory 140 is a type of random-access memory (RAM). It is often referred to as "system memory."

The memory controller hub 126 further includes a low-voltage differential signaling interface (LVDS) 132. The LVDS 132 may be a so-called LVDS Display Interface (LDI) for support of a display device 192 (e.g., a CRT, a flat panel, a projector, a touch-enabled display, etc.). A block 138 includes some examples of technologies that may be supported via the LVDS interface 132 (e.g. serial digital video, HDMI/DVI, display port). The memory controller hub 126 also includes one or more PCI-express interfaces (PCI-E) 134, for example, for support of discrete graphics 136. Discrete graphics using a PCI-E interface has become an alternative approach to an accelerated graphics port (AGP). For example, the memory controller hub 126 may include a 16-lane (x16) PCI-E port for an external PCI-E-based graphics card (including e.g. one of more GPUs). An example system may include AGP or PCI-E for support of graphics.

The I/O hub controller 150 includes a variety of interfaces. The example of FIG. 1 includes a SATA interface 151, one or more PCI-E interfaces 152 (optionally one or more legacy PCI interfaces), one or more USB interlaces 153, a LAN interface 154 (more generally a network interface for communication over at least one network such as the Internet, a WAN, a LAN, etc. under direction of the processor(s) 122), a general purpose I/O interface (GPIO) 155, a low-pin count (LPC) interface 170, a power management interface 161, a clock generator interface 162, an audio interface 163 (e.g., for speakers 194 to output audio), a total cost of operation (TCO) interface 164, a system management bus interface (e.g., a multi-master serial computer bus interface) 165, and a serial peripheral flash memory/controller interface (SPI Flash) 166, which, in the example of FIG. 1, includes BIOS 168 and boot code 190. With respect to network connections, the I/O hub controller 150 may include integrated gigabit Ethernet controller lines multiplexed with a PCI-E interface port. Other network features may operate independent of a PCI-E interface.

The interfaces of the I/O hub controller 150 provide for communication with various devices, networks, etc. For example, the SATA interface 151 provides for readings, writing or reading and writing information on one or more drives 180 such as HDDs, SDDs or a combination thereof, but in any case the drives 180 are understood to be e.g. tangible computer readable storage mediums that may not be transitory signals. The I/O hub controller 150 may also include an advanced host controller interface (AHCI) to support one or more drives 180. The PCI-E interface 152 allows for wireless connections 182 to devices, networks, etc. The USB interface 153 provides for input devices 184 such as keyboards (KB), mice and various other devices (e.g., cameras, phones, storage, media players, etc.).

In the example of FIG. 1, the LPC interface 170 provides for use of one or more ASICs 171, a trusted platform module (TPM) 172, a super I/O 173, a firmware hub 174, BIOS support 175 as well as various types of memory 176 such as ROM 177, Flash 178, and non-volatile RAM (NVRAM) 179. With respect to the TPM 172, this module may be in the form of a chip that can be used to authenticate software and hardware devices. For example, a TPM may be capable of performing platform authentication and may be used to verify that a system seeking access is the expected system.

The system 100, upon power on, may be configured to execute boot code 190 for the BIOS 168, as stored within the SPI Flash 166, and thereafter processes data under the control of one or more operating systems and application software (e.g., stored in system memory 140). An operating system may be stores in any of a variety of locations and accessed, for example, according to instructions of the BIOS 168.

FIG. 1 also shows that the system 100 includes at least one and optionally plural cameras 191 for gathering one or more images and providing input related thereto to the processor 122. The cameras 191 may be, e.g., thermal imaging cameras, digital cameras such as webcams, three-dimensional. (3D) cameras, and/or cameras integrated into the system 100 and controllable by the processor 122 to gather pictures/images and/or video, such as of a user's face and eyes (and/or eye movement, focus and/or focal length, etc.) and/or surroundings of the system 100.

Additionally, an array of microphones 193 is included on the system 100. The array of microphones 193 is understood to comprise plural microphones and provides input to the processor 122 e.g. based on sound received at the array of microphones. The microphones in the array 193 may be e.g. fiber optic microphones, pressure-gradient microphones, uni-directional microphones, cardioid microphones and/or so-called "shotgun" microphones, etc. In any case, both the cameras 191 and array of microphones are understood to be types of sensors used for undertaking present principles.

Still further, though now shown for clarity, in some embodiments the system 100 may include a gyroscope for e.g. sensing and/or measuring the orientation of the system 100 and providing input related thereto to the processor 122, an accelerometer for e.g. sensing acceleration and/or movement of the system 100 and providing input related thereto to the processor 122, and a GPS transceiver that is configured to e.g. receive geographic position information from at least one satellite and provide the information to the processor 122. However, it is to be understood that another suitable position receiver other than a GPS receiver may be used in accordance with present principles to e.g. determine the location of the system 100.

Figure 2:
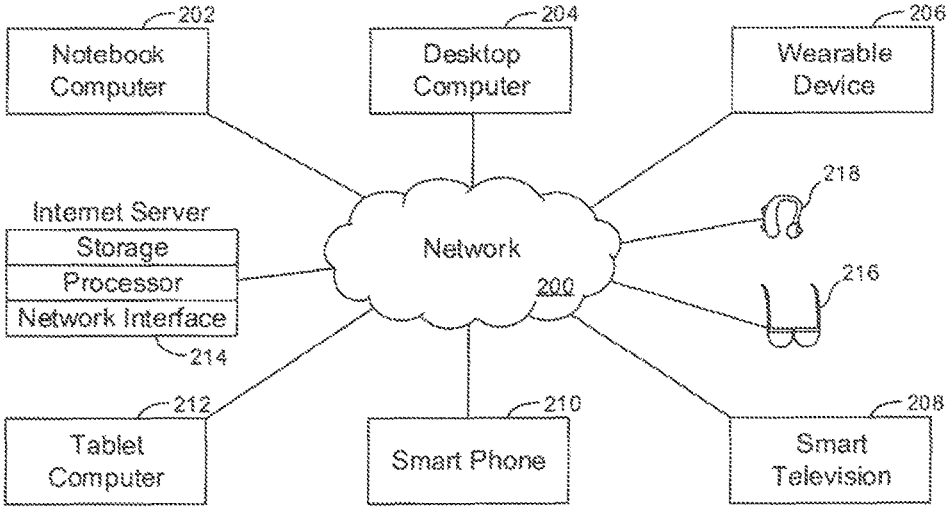
FIG. 2 is a block diagram of a network of devices in accordance with present principles.

Before moving on to FIG. 2, it is to be understood that an example client device or other machine/computer may include fewer or more features than shown on the system 100 of FIG. 1. In any case, it is to be understood at least based on the foregoing that the system 100 is configured to undertake present principles.

Turning now to FIG. 2, it shows example devices communicating over a network 200 such as e.g. the Internet in accordance with present principles. It is to be understood that e.g. each of the devices described in reference to FIG. 2 may include at least some of the features, components, and/or elements of the system 100 described above. In any case, FIG. 2 shows a notebook computer 202, a desktop computer 204, a wearable device 200 such as e.g. a smart watch, a smart television (TV) 208, a smart phone 210, a tablet computer 212, electronic glasses 216, a hearing aid 218 (e.g. comprising a microphone array, a speaker for presenting audio, and/or other elements described above in reference to the system 100), and a server 214 such as e.g. an Internet server that may e.g. provide cloud storage accessible to the devices 202-212, 216, and 218. It is to be understood that the devices 202-218 are configured to communicate with each other over the network 200 to undertake present principles.

Figure 3:
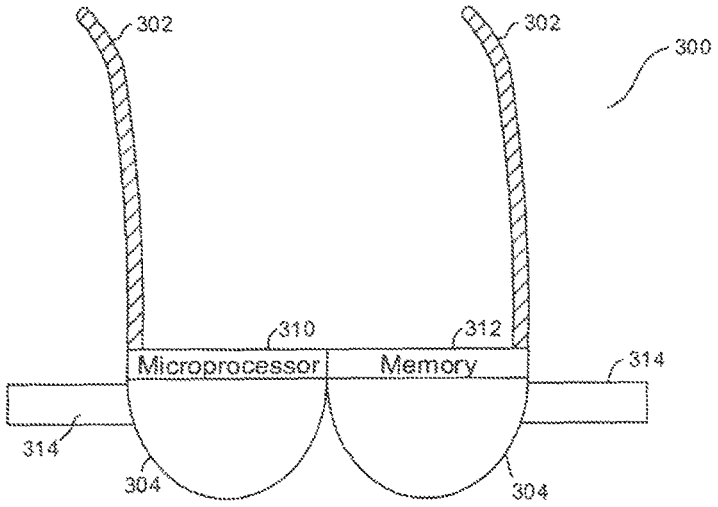
FIG. 3 is a perspective view of an example wearable device in accordance with present principles.

Referring to FIG. 3, it shows a perspective view of example eye glasses 300 that may be used in accordance with present principles (e.g. to identify an object being looked at by the user when wearing the glasses upright on their head based at least in part on the direction and/or depth of a user's focus in accordance with present principles), it being understood that the system 100 may be e.g. embodied at the glasses 300 and accordingly the glasses 300 may include some or all of the elements of the system 100 discussed above. In any case, the glasses 300 include a frame 302 which may comprise elongated arms for positioning over the ears of a person, as well as a center portion between the elongated arms at respective first ends of the arms to connect the arms, and/or engage with and/or couple to one or more lenses and other components of the glasses 300 to be described below.

Thus, the glasses 300 include one or more at least partially transparent lenses, 304 through which a user may view objects in the user's line of sight when the glasses 300 are worn upright on their face, such as e.g. other people, surround sound speakers, a television, etc.

In addition to the foregoing, the glasses 300 may also include a processor 310, and memory 312 accessible to the processor 310 and storing data such as e.g. instructions executable by the processor 310 to undertake present principles (e.g. instructions including the logic discussed in reference to FIGS. 4A and 4B below). As also shown in FIG. 3, the glasses 300 may comprise one or more cameras 314 such as e.g. digital cameras and/or cameras configured and/or oriented for gathering images of at least one and optionally plural of a user's eyes (e.g. and specifically their pupils) when wearing the glasses 300 and/or to track eye movement of the eyes of the user when wearing the glasses. Thus, using eye tracking principles and/or software, the processor 310 may determine which direction and/or to which objects the user is looking, as well as determine the depth of the user's focus.

Before moving on to the description of FIG. 4, it is to also be understood in reference to the glasses 300 of FIG. 3 that they may comprise a network interface for communication over at least one network such as the Internet, a WAN, a LAN, etc. under direction of the processor(s) 310 with another device such as e.g. a smart phone, laptop computer, tablet computer, display device, and/or a hearing aid (e.g. the hearing aid 218 shown in FIG. 2), and furthermore the glasses 300 may comprise e.g. a battery providing power to one or more elements of the glasses 300, where the battery is chargeable through a charge port on the glasses 300 which is in electrical communication with the battery.

Figure 4A:
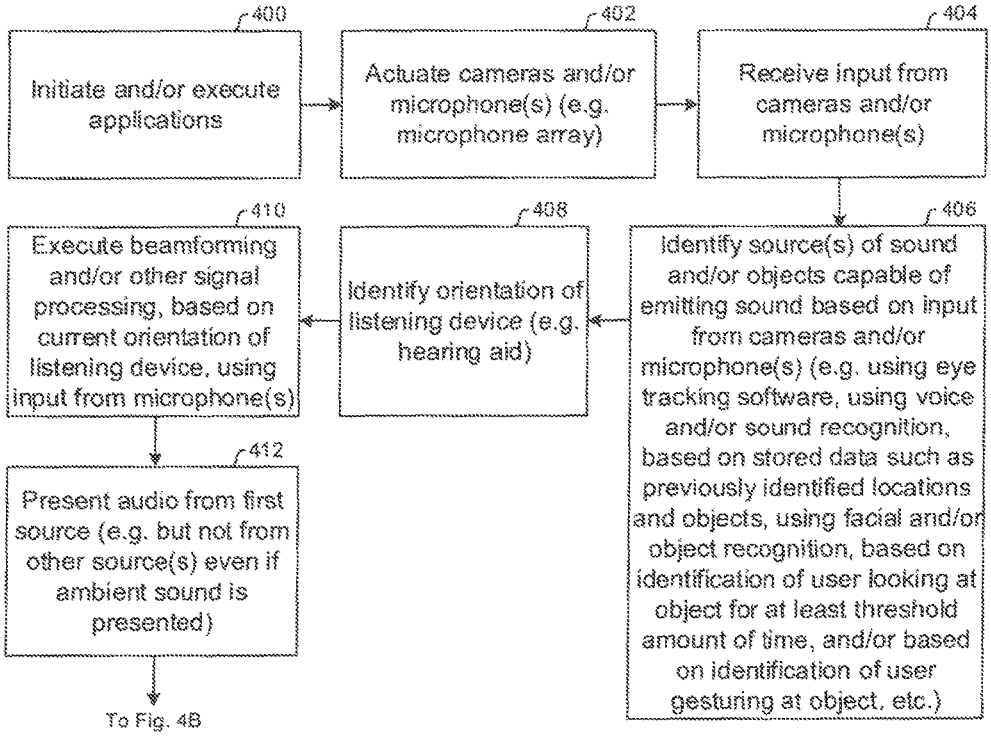
FIGS. 4A and 4B are flow charts showing an example algorithm in accordance with present principles.

Referring to FIG. 4A, it shows example logic that may be undertaken by a device such as a wearable device (e.g. smart glasses) and/or the system 100 in accordance with present principles (referred to below as the "present device"). Beginning at block 400, the logic initiates and/or executes one or more applications for undertaking present principles, such as e.g. a camera application(s), a microphone application(s), a gesture recognition application(s), a facial recognition application(s), an object recognition application(s), an eye tracking application(s), a sound and/or voice recognition application(s), a single application integrating at least two of the foregoing applications, etc.

After block 400 the logic moves to block 402 where the logic actuates one or more cameras and one or more microphones (e.g. as microphone array) to respectively gather images and sound. The logic then moves to block 404, where the logic receives input from at least one of the camera(s) and microphone(s), in response to receipt of the input at block 404, the logic moves to block 406.

At block 406, the logic identifies one or more sources of sound, and/or objects capable of emitting sound, based on the input from the cameras and/or microphones. For instance, based on input from cameras directed toward the user's eyes and/or input from cameras directed outwardly away from the user which provide a field of view of a room in which the user is disposed, the present device may identify a location and/or object in the room at which the person is looking (e.g. by analyzing the direction of focus of the user's eyes as shown in one or more images of the user's face using eye tracking software (e.g. based on the orientation of the user's pupils in relation to the rest of their eye), and also the depth of focus of the user's eyes as shown in one or more images of the user's face using eye tracking software). In some embodiments, the present device may identify something being looked at by the user as a source of sound and/or input indicating something capable of producing sound responsive to identification of the user looking at such an object for a threshold time (e.g. to thus disregard momentary glances at things for less than the threshold time). The present device may also, based on input from a camera imaging the user and another camera imaging the room, and/or based on input front a motion sensor on the present device (e.g. an accelerometer), determine that the user is gesturing at a particular object in the room (e.g. a predefined gesture such as pointing with their finger in a particular direction, nodding their head in a particular direction, pointing their chin in a particular direction, etc.).

The logic may also identify one or more sources of sound, and/or objects capable of emitting sound, based on the input from the cameras in still other ways as well. For instance, using images from one of the cameras showing a field of view of at least a portion of the room, the logic may execute facial recognition and/or object recognition on at least some of the pixels in the image(s) to identify objects shown therein (e.g. a person with their mouth open from which it may be determined that they are emitting sound, a speaker which is recognized as being capable of producing sound when powered, etc.). Furthermore, once the objects are identified, in some embodiments the logic may e.g. reference a data table correlating types of objects with data pertaining to whether they are capable of producing sound, and/or with data pertaining to whether a riser has indicated the objects as being sources of sound, to thus determine based on the data whether one or more objects in the room and shown in the image(s) are capable of producing sound and should thus be targeted for providing audio therefrom in a listening device (e.g. hearing aid). An example of such a data table will be discussed below in reference to FIG. 5. Regardless, it is to also be understood that in some embodiments, e.g. the device may be configured to automatically identify a face of a person as being an object capable of producing sound e.g. without referencing such a data table.

Even further, in addition to or in lieu of the foregoing, in some embodiments GPS coordinates may be exchanged between the present device and sound sources to determine the location of the sound sources.

Still in reference to block 406, and providing yet another example, the logic may identify one or more sources of sound, and/or objects capable of emitting sound, based on input from the microphones by executing e.g. voice recognition and/or sound recognition on the input to identify a particular person's voice (e.g. for which a user has previously provided input to the device as being a person from which sound should be presented on the user's listening device), to identify sound as being emitted from a loudspeaker (e.g. based on sound characteristics such echoes from the loudspeakers that may be detected), to identify sound as being from a recognizable and/or recognized television show or musical album etc. The sounds may also be identified e.g. based on the direction from which the sound comes as identified using input from an array of microphones.

Still in reference to FIG. 4A, after block 406 the logic moves to block 408, where the logic identifies art orientation of a listening device at which audio and/or sound from the identified source(s) is to be presented. The orientation of the listening device may be determined e.g. based on input from a camera imaging the user's head (e.g. if the listening device is a hearing aid, to thus determined based on the orientation of the users head what the orientation of the listening device is while being worn) and/or based on input from an inertial sensor (e.g. accelerometer) in the listening device itself.

Thereafter, the logic moves to block 410 where it executes beamforming and/or other signal processing (e.g. one or more other signal processing algorithms) on received sound input from the microphone(s) based on the orientation of the listening device (e.g. and hence the orientation of a microphone array on the listening device at which sound from the identified source(s) is being collected the presentation at the listening device). Based on the beamforming and/or other signal processing at block 410, the logic at block 412 present audio from a source (referred to below as the "first source") and optionally gland sources. Furthermore, in some embodiments, at block 412 the present device may present audio at the listening device from at least substantially only from the first source is such that e.g. audio comprising sound at least substantially only from the first source is presented along with ambient sound (e.g. so-called "dark-noise" caused by electric current to and from the microphone, other minor microphone interferences and/or feedback, unintentional and/or unavoidable sounds of static, etc.), but notably not sound from another particular end/or identifiable/identified source. However, in other embodiments sound from two distinct, particular, and/or identifiable/identified sources may be concurrently and/or simultaneously provided (e.g. at different volume levels both greater than zero based on configurations of the device set by the user), such as two people speaking at the same time. In any case, after block 412 the logic proceeds to decision diamond 414, which is shown in FIG. 4B.

Figure 4B:
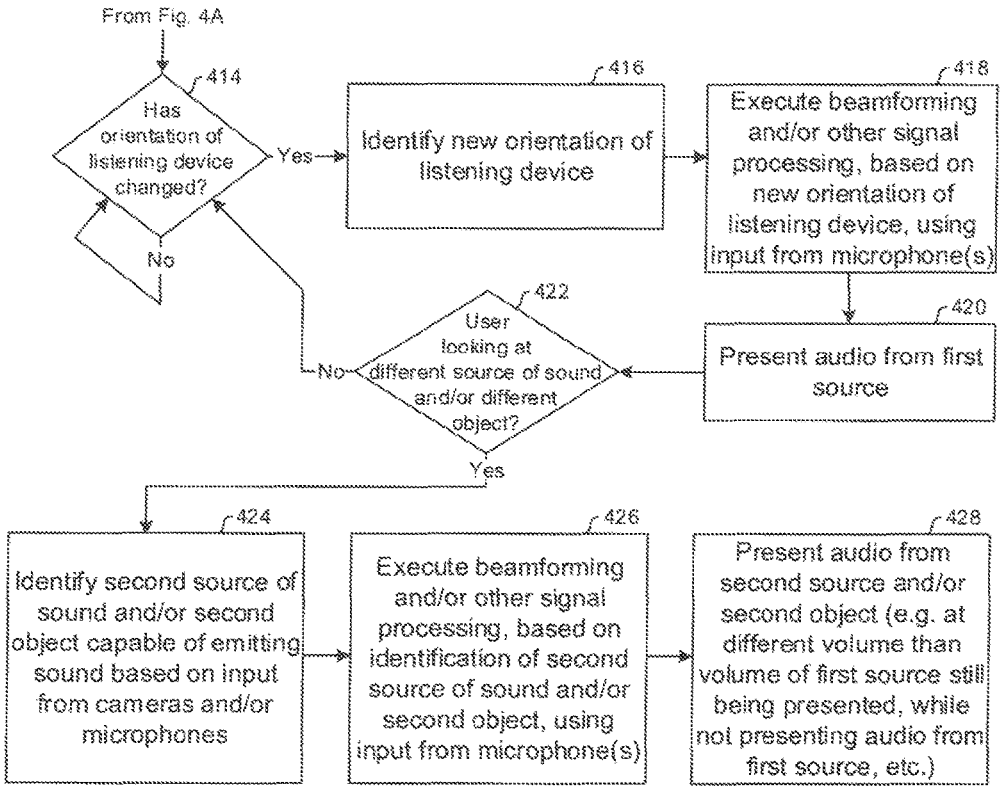

Thus, at decision diamond. 414 of FIG. 4B, the logic determines whether an orientation of the listening device has changed (e.g. based on input from an accelerometer on the listening device). A negative determination at diamond 414 causes the logic to continue making the determination thereat until an affirmative one is made. Then, responsive to an affirmative determination at diamond 414, the logic proceeds to block 416, at which the logic identifies the new orientation of the listening device. The logic then at block 418 again executes beamforming and/or other signal processing using input from the microphone(s) as described herein based on the new orientation of the device, and then at block 420 presents and/or continues presenting audio from the first source.

From block 420 the logic next proceeds to decision diamond 422 of FIG. 4B, where the logic determines whether the use (e.g. based on input from an accelerometer on a device being worn by the user and/or based on input from a camera of such a device being used to track the users eye movement in accordance with present principles) is looking at least toward (e.g. directly it within a threshold number of degrees of directly at, etc.) a different object than was previously being looked at. A negative determination at diamond 422 causes the logic to proceed back to diamond 414, where it may proceed therefrom. However, an affirmative determination at diamond 422 instead causes the logic to move to block 424, where the logic determines whether the object being looked at is a source of sound and/or a different object capable of emitting sound (referred to below as the "second source").

From block 424 the logic moves to block 426, where the logic executes beamforming and/or other signal processing using input from the microphones to present sound at the listening device from the second source based on identification of the second source. The logic then proceeds to block 428, where the logic presents audio at the listening device from the second source. In some embodiments, the audio may be presented at a different volume level than the volume level at which audio from the first source was presented (e.g. based on configurations set by the user), and/or may present audio from the second source while not presenting audio from the first source (e.g. until the user again looks away from the second source and back toward the first source).

Figures 5, 6:
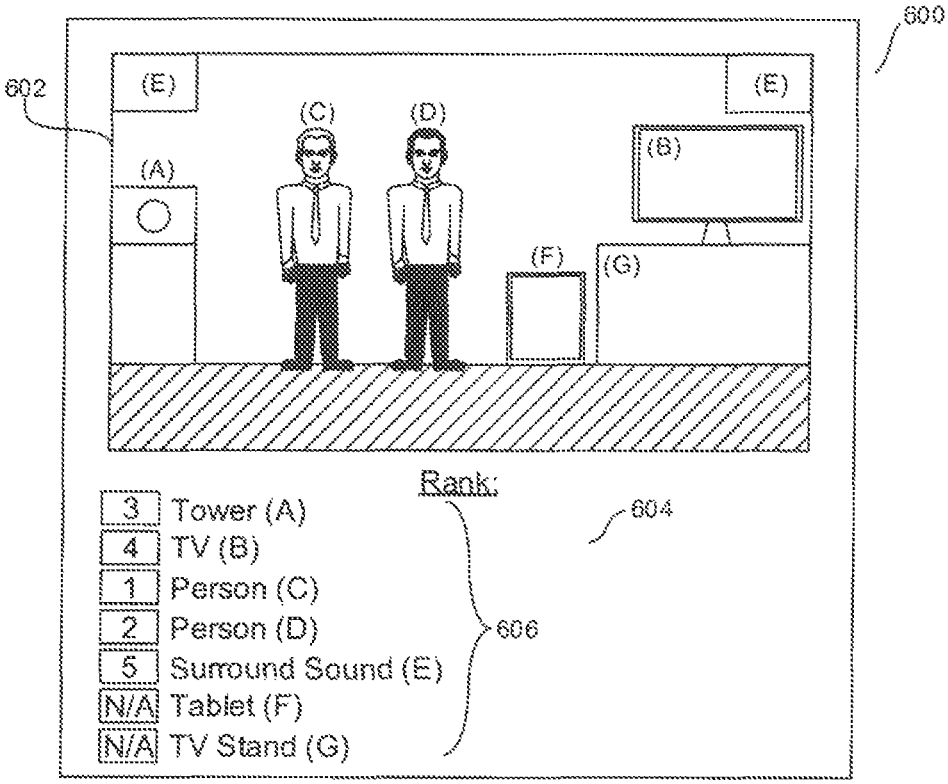
FIG. 5 is an example data table in accordance with present principles.
FIGS. 6 and 7 are example user interfaces (UIs) in accordance with present principles.

Before moving on to the description of FIG. 5, it is to be understood in reference to FIGS. 4A and 4B that performance of the various steps shown in these figures may be done in any order and that, for example, the device may be at least periodically determining whether the orientation of the listening device has changed even while performing another step as well so that beamforming can be adjusted and hence the user does not hear any perceptible interruption in audio from a given source based on their movement (e.g. while wearing the listening device) and/or another change in orientation of the listening device.

Now describing FIG. 5, it shows an example data table 500 in accordance with present principles. The data table comprises a first column 502 of entries of objects and/or object types, and a second column 504 of entries of data regarding whether a user of a device e.g. configured to undertake the logic of FIGS. 4A and 4B has identified the object and/or object type shown in the same row at column 502 for the respective entry as being a source of sound and/or a source capable of emitting sound for which audio should be presented at a listening device in accordance with present principles when such an object is recognized and/or identified by the user's device. The data table 500 also includes a third column 506 of entries of data regarding whether a particular object and/or object type shown in the same row at column 502 for the respective entry is an object capable of emitting sound for which audio should be presented at the listening device when such an object is recognized and/or identified by the user's device. For example, the data in the respective entries in column 506 may have been inserted e.g. by a device programmer and/or application programmer, rather than indicated by the end-user of the device.

In any ease, it may be appreciated based on FIG. 5 that once an object and/or object type has been recognized from an image in accordance with present principles, the device may access the data table 500 (e.g. which may be stored at the device and/or at another location accessed over a network) to locate an entry in column 502 corresponding to the recognized object and/or object type, and then access data at either or both of columns 504 and 506 for the entry to determine whether the recognized object is a source of sound for which audio therefrom should be presented at the a listening device and/or to determine whether the recognized object is capable of emitting sound for which audio therefrom should be presented at the a listening device.

Continuing the detailed description in reference to FIG. 6, it shows an example user interface (UI) 600 presentable on a display of a device such as e.g. a wearable device (e.g. an at least partially transparent lens display (e.g. a so-called "heads-up" display) of smart glasses) and/or another device undertaking present principles such as the system 100. The UI 600 includes an example image 602 presented thereon which is understood to be an image gathered by the device and showing e.g. a field of view a room in which the device is presently disposed.

As may be appreciated from the image 602, it has superimposed thereon (e.g. by the device) alphabetical indicators corresponding to objects in the image that have been recognized by the device (e.g. by executing object recognition software on the image 602). Beneath the image 602 on the UI 600 is an area 604 dynamically generated by the device based on the objects it hits recognized the a given image (e.g. from the image 602 in this case) at which the user may rank the recognized objects as identified based on the alphabetical indicators and/or text descriptions shown) based on order of priority for presenting audio from them at a listening device (e.g. an object with a ranking of one has audio presented therefrom if concurrently producing sound before a lower-ranked object such as e.g. one with a ranking of three). Thus, each of the entries 606 shown includes a respective number entry box at which a user may enter (e.g. by selecting the box as the active box and then providing input of a number) and/or select a number (e.g. from a drop-down menu of numbers presented in response to selection of a given box).

Thus, it is to be understood that an object with as higher rank (e.g. and hence a lower number, such as and when producing sound at a given moment gets its sound presented at the listening device while other objects with a lower ranking (e.g. and hence higher number such as five) also producing sound at that moment do not have sound therefrom presented at the listening device. However, if e.g. objects ranked higher than five are not determined to be producing sound at a moment that the object ranked five is producing sound, the sound from the object ranked number five is presented at the listening device.

Accordingly, as may be appreciated from FIG. 6, the first five objects listed from to bottom have been ranked according to the user's preference. The bottom two objects have not been ranked and instead display the designation "N/A"—meaning "not applicable"—owing to the user providing input to those boxes selecting the N/A designation and/or otherwise providing input to the device to not present audio at a listening device from the respective object e.g. even if sound is being produced. Thus, taking object F as an example, which has been identified from the image as a tablet computer, it may be appreciated from the UI 600 that the user has configured, based on input to the respective input box shown for object F, to not present audio therefrom at a listening device in accordance with present principles (e.g. regardless of whether the tablet is emitting and/or producing sound, regardless of whether the user looks at the tablet for a threshold time as described herein, etc.).

Figure 7:
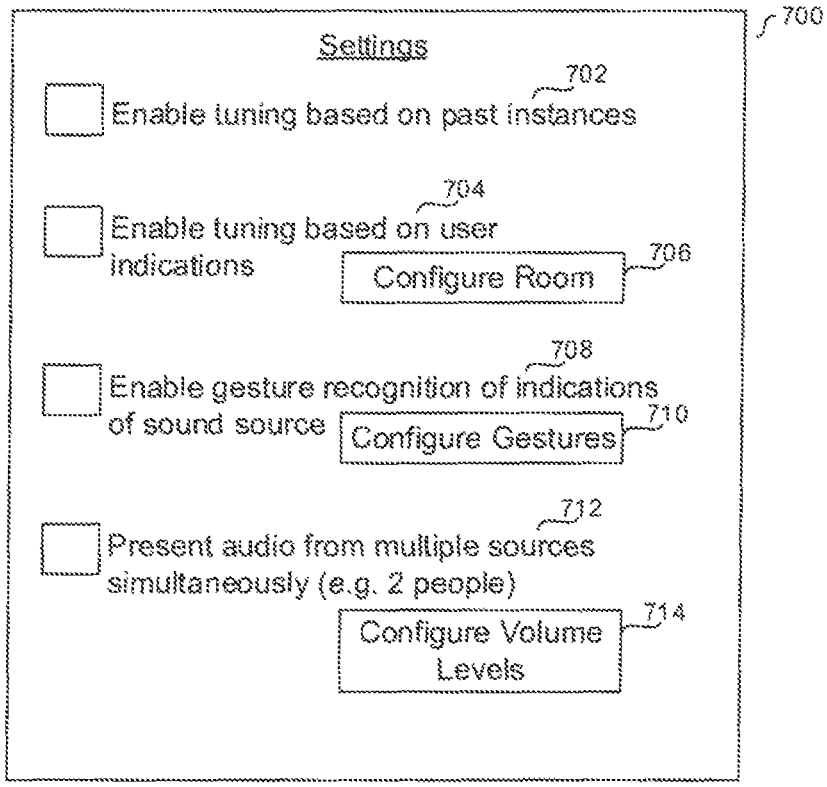

Continuing now in reference to FIG. 7, it shows an example UI 700 for configuring settings of a device undertaking present principles which is presentable on a display of such a device. Before describing the particular settings shown, it is to be understood that each one has a check box next to it as shown which is selectable to automatically without further user input enable the respective setting.

Thus, as may be appreciated from FIG. 7, the UI 700 includes a first setting 702 to enable tuning (e.g. presenting audio at a listening device) based on past instances and/or data from previous instances that have been stored (e.g. where a user previously performed a gesture indicating that a particular object should be tuned to using the listening device, e.g. where a user previously indicated an object as being capable of producing sound, e.g. where an object was previously recognized based on object recognition as being capable of producing sound, etc.), it being understood that data of these past instances is accessible to the device (e.g. stored at the device itself). Thus, objects in places visited more than one (e.g. frequently) by a user and their device such as the user's office, the user's place of worship, the user's home, etc. may be more quickly and readily identified and/or otherwise have sound therefrom presented on the user's listening device.

The UI 700 also includes a second selling 704 to enable tuning based on user indications (e.g. future indications yet to be received by the device, such as gestures to tune to an object producing sound in a location never visited before by the user with the device). Note that the setting 704 may include a selector element 706 selectable to e.g. cause another UI to be presented from which a user may configure the device, in accordance with the device's current surroundings, to present audio from various objects in the surroundings. Thus, in some embodiments, selection of the element 706 may automatically without further user input cause a UI similar to the example UI 600 described above to be presented (e.g. cause the device to automatically generate an image of at least a portion of the surroundings, recognize objects in the image, and present the UI 600 for a user to rank objects or merely indicate using touch input to the device objects capable of and/or actually producing sound to configure the device to be aware of and monitor for potential sounds coming from the indicated objects).

Still in reference to the UI 700, it may also include a third setting 708 to enable gesture recognition of gesture indications from a user of sources of sound and/or objects capable of producing sound. E.g. when the setting 708 is enabled, the device is configured, based on input from one of its cameras, to recognize the user as pointing toward an object. The device may then identify the object as emitting sound and tune to the object. Note that the setting 708 has a selector element 710 associated therewith which is selectable to automatically without further user input cause another UI to be presented from which a user may configure the device to recognize particular and/or predetermined gestures. For example, responsive to selection of the element 710, the device may present another UI prompting a user to gesture a desired gesture in a direction toward the device which will cause the device to generate data therefrom associating the gesture with an indication of a source of sound so that when the user gestures the particular gesture at a later time, by executing gesture recognition software on one or more images showing the gesture, the device may recognize the gesture as an indication of a source of sound in accordance with present principles.

The example UI 700 also includes a fourth setting 712 to enable presentation of audio at a listening device from multiple sound sources at the same time, such as e.g. sound from two people simultaneously conversing with the user. Thus, a selector element 714 is presented which is selectable by a user to automatically without further user input cause a UI to be presented from which a user may preconfigure volume levels of audio output at the listening device based on particular objects and/or people. For instance, using the example of two people conversing again, the device may store snapshots (e.g. head shots) of the two people conversing so that at the time of the conversing or at a later time, selection of the element 714 causes a UI to be presented which shows the snapshots and has respective volume adjustment slider bars juxtaposed adjacent thereto which are manipulable by the user to establish varying volume levels for presentation of sound at the listening device from each of the two people.

Without reference to any particular figure, it is to be understood that a device in accordance with present principles may switch between the targeting of sound sources based on e.g., where user is looking, where the sound is coming from, based on people talked with more often than others (e.g. people talked with more than a threshold number of times and/or more times than another person present in the room and/or engaging in conversation get focused in on above the other people talked with less frequently), and/or providing audio from simultaneous talkers but with the sound feed having a louder volume for one of the people than the other when presented to the user.

Also without reference to any particular figure, it is to be understood that in some embodiments a device may "look" for certain faces and/or objects (e.g. only) at certain times (times of day, day of the week, month, etc.) based on past use e.g. to thus conserve battery life. Further, in some embodiments, prior to targeting and/or actuation of a camera as disclosed herein, a device may "look" for sound sources, using voice recognition, based on whether the sound is from a previously identified and/or previously targeted person and then perform other functions in accordance with present principles (e.g. only) when a voice is recognized. E.g. at the point the voice is recognized, the camera may be actuated as disclosed herein, and/or the device may otherwise target the sound source without use of a camera (e.g. just based on the direction of the sound as determined based on input from the microphone array).

Still without reference to any particular figure, it is to be understood in accordance with present principles that a user may configure the device to e.g. block sound from some sources (e.g. no matter what and/or until user input to unblock is received), such as configuring the device to block sound from a particular person but always present sound from a television in the user's living room.

Also, it is to be understood that although targeting audio sources in accordance with present principles has been disclosed to include beamforming, it is to be understood that e.g. a (e.g. uni-directional) microphone on a listening device may be used to target a sound source by mechanically and/or electronically altering the orientation of the microphone itself relative to the device to which it is coupled to thus receive sound from the source, and/or by actuating (e.g. uni-directional) particular microphones in an array which have been disposed at varying orientations based on the direction of the target.

Still further, in some embodiments e.g. speech to text recognition may be employed by a device undertaking present principles to present on a display (e.g. on a lens display if the user is wearing electronic glasses which track their eyes, on a television designated by the user, on a tablet display designated by the user, etc.) text and/or representations of audio from the sound source (e.g. closed-caption-like text) once the sound source has been identified.

It may now be appreciated that present principles provide for e.g. using eye tracking and object identification to determine a target audio source. E.g., a wearable device with a camera may use eye tracking to identify candidate audio sources. Once an audio source is targeted (e.g. a person, TV, loudspeaker, etc.), one or more microphones worn by the user may target that device for audio instead of receiving e.g. omnidirectional audio from other potential sources.

Examples of audio targets in accordance with present principles include e.g. a person speaking that the user is looking at (e.g. the person that is talking would be identified using eye tracking, face detection, and/or identification of the person's mouth as moving and/or at least partially open), a television and/or device playing video, audio, and/or audio-video content (e.g. the device may be targeted based on the user looking at the device for a preconfigured threshold and/or identification of the TV as currently presenting video content), and a standing or mounted speaker associated with a person or device (e.g. the audio source may be identified based on a determination that audio originates from a speaker, where the speaker itself would be identified using input from a camera to identity the speaker (and/or its position, such as hanging on a wail, standing on a floor, pole-mounted, etc.), and then the speaker may become the targeted audio source).

Furthermore, it is to be understood in accordance with present principles that should a user wearing a listening device as described herein look e.g. down or away from a sound source, microphone beaming may be re-aligned to keep the audio source targeted despite the movement. This allows the user to look away to e.g. eat a meal, etc. without losing audio from a conversion in which they are engaged.

What's more, in some embodiments, once people and/or objects (e.g. speakers in a building such as a church or other place of frequent visit of a user) are identified by the device along with their location and time of day and/or day of week of emitting sound, these people and/or objects, and their locations and times of sound emission, may be "remembered" by the device for future targeting e.g. based on time, location, etc. (e.g. the device stores data related to the objects, their identification, their location, and/or their (e.g. sound-emitting) characteristics for later identification based on the device later being at the same location and/or it being the same time of day as when they were previously identified). Even further, these remembered audio sources may be used for switching between audio sources during a conversation.

For instance, the camera may keep track of multiple people speaking during a conversation. If the camera detected another person's mouth moving and that the other person's stops moving or talking, the "direction" of the microphone could be automatically pointed to the currently speaking person (e.g. without the need for the user to look at the newly talking person). This may happen automatically as different people talk during a conversation. Also, frequent people the user talks to may be remembered (e.g. have data related thereto stored at the device) for directing the microphone quicker in future conversations.

Still further, in some embodiments a gesture may be recognized by the device as a command to present audio from an object in the direction being gestured. For example, before switching audio to a new person, a "chin point" or "head nod" may be required to direct the directional microphones at the new person talking (and/or other object now producing sound, such as a loudspeaker).

it is to be further understood in accordance with present principles that, e.g. if an audio source were misinterpreted and/or misidentified by a device, and/or the device was unable to confidently identify the object, the device may permit the user to select the best audio source from an image of a field of view of the device's surroundings for future sound source targeting (e.g. where a loudspeaker is inconspicuous and/or difficult to automatically identify).

Before concluding, it is to be understood that although e.g. a software application for undertaking present principles may be vended with a device such as the system 100, present principles apply in instances where such an application is e.g. downloaded from a server to a device over a network such as the Internet. Furthermore, present principles apply in instances where e.g. such an application is included on a computer readable storage medium that is being vended and/or provided, where the computer readable storage medium is not a transitory signal and/or a signal per se.

While the particular PRESENTATION OF AUDIO BASED ON SOURCE is herein shown and described in detail, it is to be understood that the subject matter which is encompassed by the present application is limited only by the claims.

What is claimed is:

1. A device, comprising:

at least one processor; and storage accessible to the at least one processor and bearing instructions executable by the at least one processor to:

present a graphical user interface (GUI) on a display accessible to the at least one processor, the GUI comprising one or more input areas at which a user is able to establish a priority of at least one through three for presentation of audio from respective first, second, and third sources of sound so that audio is presented for at least one higher-prioritized source of sound over audio for at least one lower-prioritized source of sound; and based at least in part on input from at least one microphone, execute beamforming and present, based on the priority, audio at a hearing aid comprising sound from the first source of sound should sound be emanating from the first source of sound, otherwise execute beamforming and present, based on the priority, audio at the hearing aid comprising sound from the second source of sound should sound be emanating from the second source of sound, otherwise execute beamforming and present, based on the priority, audio at the hearing aid comprising sound from the third source of sound should sound be emanating from the third source of sound.

2. The device of claim 1, wherein the at least one microphone comprises an array of microphones, wherein the device comprises the array and the hearing aid, and wherein the array of microphones is disposed on the hearing aid.

3. The device of claim 1, wherein the device wirelessly communicates with the hearing aid.

4. The device of claim 1, wherein the GUI is a first GUI, and wherein the instructions are executable by the at least one processor to:

present a second GUI on the display, the second GUI comprising a setting that is selectable by a user to enable the device to present audio at the hearing aid based on beamforming.

5. The device of claim 1, wherein the instructions are executable by the at least one processor to:

receive user input that preconfigures the device to block presentation of audio at the hearing aid that comprises sound from a fourth source of sound, the fourth source of sound being different from the first, second, and third sources of sound; and block, based on the user input, presentation of audio at the hearing aid that comprises sound from the fourth source of sound.

6. The device of claim 1, wherein the GUI comprises plural input areas for establishing the priority, each respective input area of the plural input areas being configured to receive user input specifying a different number for the priority.

7. The device of claim 6, wherein each input area is associated with a different source of sound.

8. The device of claim 7, wherein each input area is associated with a different source of sound via text.

9. The device of claim 7, wherein each input area is associated with a different source of sound via a non-text image.

10. The device of claim 1, wherein the instructions are executable by the at least one processor to:

receive input to the GUI establishing the priority.

11. A method, comprising:

presenting a graphical user interface (GUI) on a display, the GUI comprising one or more input areas at which a user is able to establish a priority of at least one through three for presentation of audio from respective first, second, and third sources of sound so that audio is presented for at least one higher-prioritized source of sound over audio for at least one lower-prioritized source of sound; and based at least in part on input from at least one microphone, executing beamforming and presenting, based on the priority, audio at a hearing aid comprising sound from the first source of sound should sound be emanating from the first source of sound, otherwise executing beamforming and presenting, based on the priority, audio at the hearing aid comprising sound from the second source of sound should sound be emanating from the second source of sound, otherwise executing beamforming and presenting, based on the priority, audio at the hearing aid comprising sound from the third source of sound should sound be emanating from the third source of sound.

12. The method of claim 11, comprising:

receiving input to the GUI to establish the priority.

13. The method of claim 11, wherein the GUI is a first GUI, and wherein the method comprises:

presenting a second GUI on the display, the second GUI comprising a setting that is selectable by a user to enable a device to present audio at the hearing aid based on beamforming.

14. The method of claim 11, comprising:

receiving user input that preconfigures a device to block presentation of audio at the hearing aid that comprises sound from a fourth source of sound, the fourth source of sound being different from the first, second, and third sources of sound; and blocking, based on the user input, presentation of audio at the hearing aid that comprises sound from the fourth source of sound.

15. The method of claim 11, wherein the GUI comprises plural input areas for establishing the priority, each respective input area of the plural input areas being configured to receive user input specifying a different number for the priority.

16. The method of claim 15, wherein each input area is associated with a different source of sound.

17. The method of claim 16, wherein each input area is associated with a different source of sound via text.

18. The method of claim 16, wherein each input area is associated with a different source of sound via a non-text image.

19. A computer readable storage medium (CRSM) that is not a transitory signal, the computer readable storage medium comprising instructions executable by at least one processor to:

present a graphical user interface (GUI) on a display accessible to the at least one processor, the GUI comprising one or more input areas at which a user is able to establish a priority of at least one through three for presentation of audio from respective first, second, and third sources of sound so that audio is presented for at least one higher-prioritized source of sound over audio for at least one lower-prioritized source of sound; and based at least in part on input from at least one microphone, execute beamforming and present, based on the priority, audio at a hearing aid comprising sound from the first source of sound should sound be emanating from the first source of sound, otherwise execute beamforming and present, based on the priority, audio at the hearing aid comprising sound from the second source of sound should sound be emanating from the second source of sound, otherwise execute beamforming and present, based on the priority, audio at the hearing aid comprising sound from the third source of sound should sound be emanating from the third source of sound.

20. The CRSM of claim 19, wherein the instructions are executable by the at least one processor to:

receive input to the GUI establishing the priority;

wherein the GUI comprises plural input areas for establishing the priority, each respective input area of the plural input areas being configured to receive user input establishing a different number for the priority, and wherein each input area is associated with a different source of sound.

* * * * *